US005671700A

United States Patent [19]

Lackstrom

[11] Patent Number: 5,671,700

[45] Date of Patent: Sep. 30, 1997

[54] HIGH EFFICIENCY WATER BOILER HAVING FINNED HEAT EXCHANGER

[75] Inventor: David Lackstrom, Medina, Ohio

[73] Assignee: Glowcore Acquisition Company, Chicago, Ill.

[21] Appl. No.: 525,223

[22] Filed: Sep. 8, 1995

Related U.S. Application Data

[63] Continuation of Ser. No. 260,335, Jun. 15, 1994, abandoned.

[51] Int. Cl.[6] ..... F22B 7/04

[52] U.S. Cl. ..... 122/169; 122/245; 122/250 R; 122/367.3

[58] Field of Search ..... 122/18, 169, 245, 122/248, 250 R, 367.3

[56] References Cited

U.S. PATENT DOCUMENTS

| | | | |
|---|---|---|---|
| 3,359,949 | 12/1967 | Bjarnason et al. | 122/248 |
| 4,442,799 | 4/1984 | Craig et al. | 122/250 R |
| 4,589,374 | 5/1986 | Farina | 122/14 |
| 5,131,351 | 7/1992 | Farina | 122/250 R |

FOREIGN PATENT DOCUMENTS

| | | | |
|---|---|---|---|
| 538122 | 3/1922 | France | 122/250 R |
| 1090679 | 10/1954 | Germany | 122/248 |

*Primary Examiner*—Henry A. Bennett
*Assistant Examiner*—Susanne C. Tinker
*Attorney, Agent, or Firm*—Lightbody & Lucas

[57] ABSTRACT

This invention relates to a natural gas fire water boiler having a spirally wrapped finned heat exchanger surrounding a burner. The center of the heat exchanger being plugged by a core having a constantly reducing diameter truncated cone top.

36 Claims, 3 Drawing Sheets

HIGH EFFICIENCY WATER BOILER HAVING FINNED HEAT EXCHANGER

This is a streamlined continuation application of U.S. Ser. No. 08/260,335 filed Jun. 15, 1994 entitled Water Boiler which application is now abandoned.

FIELD OF THE INVENTION

This invention relates to a high efficiency fluidic or gas fired water boiler.

BACKGROUND OF THE INVENTION

Conventionally water boilers are commonly used in order to increase the temperature of water. Examples of water boilers include household furnaces, water heaters, and the like. A type of water boiler includes a generally cylindrical helically coiled finned heat exchanger tube surrounding an open center cavity containing a burner at one end and a core at the other end. The water within the heat exchanger tube is contained available for thermal transfer. The purpose of the burner is to provide products of combustion which, passing over the coiled heat exchanger tube, transfer heat thereto. The purpose of the core is to concentrate on the flow of these products of combustion to the area immediately adjacent to the coiled heat exchanger tube at this location so as to increase the efficiency of the heat transfer therebetween.

A difficulty of these water boilers is that they run at low temperatures on start up, particularly where the boiler is undersized for part of the operating time (i.e., lacks a tremendous reserve). These low temperature operations tend to produce contaminants, particularly on the exchanger adjoining the top of the core. This increases back pressure while also reducing thermal transfer efficiency.

The present invention is directed to improving the nature and construction of water boilers so as to increase the operational efficiency and service life thereof.

OBJECTS AND SUMMARY OF THE INVENTION

It is an object of the present invention to improve the efficiency of water boilers.

It is another object of the present invention to lengthen the service life of water boilers.

It is yet another object of the present invention to reduce the buildup of hydrocarbons and other contaminants on the fins of heat exchanger coils.

It is still another object of the present invention to improve the flow and heat transfer coefficients of products of combustion in a water boiler.

It is a further object of the present invention to provide for a concentrated heat source at the junction between the core and coiled heat exchanger tube and following areas.

It is yet still another object of the present invention to increase the manufacturing efficiency for constructing boilers.

Other objects and a more complete understanding of the invention may be had by referring to the following description and drawings in which:

BRIEF DESCRIPTION OF THE DRAWINGS

The structure, operation, and advantages of the presently disclosed preferred embodiment of the invention will become apparent in consideration of the following description taken in conjunction with the accompanying drawings wherein.

DETAILED DESCRIPTION OF THE INVENTION

The invention relates to a water boiler.

Figure 1:
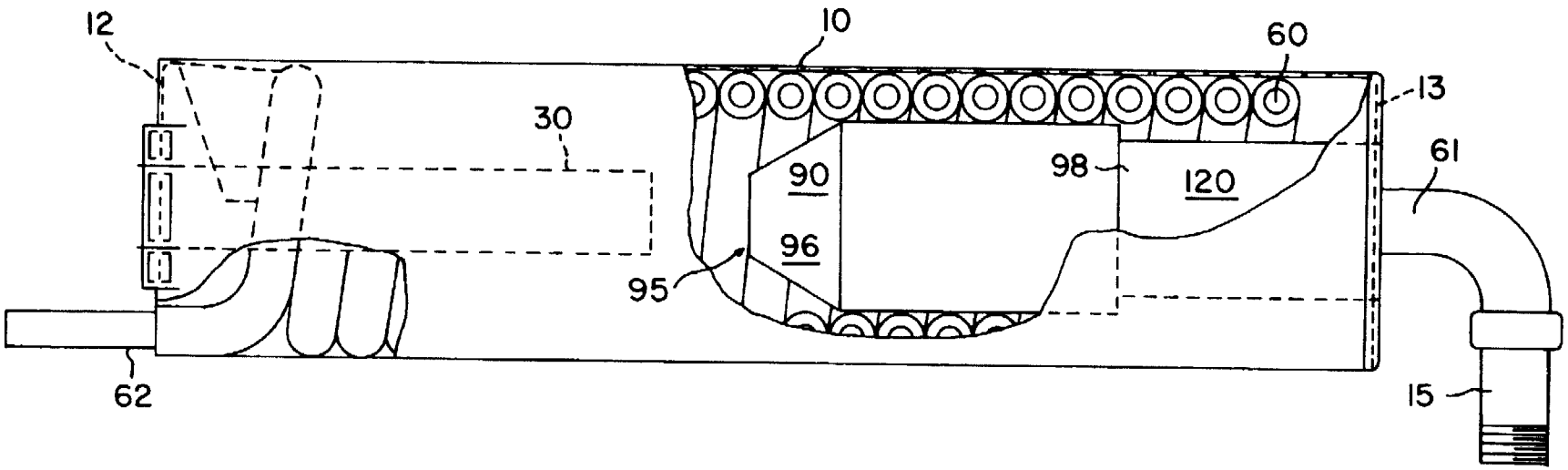
FIG. 1 is a longitudinal cross sectional view of a natural gas water boiler incorporating the invention of the application.
Figure 2:
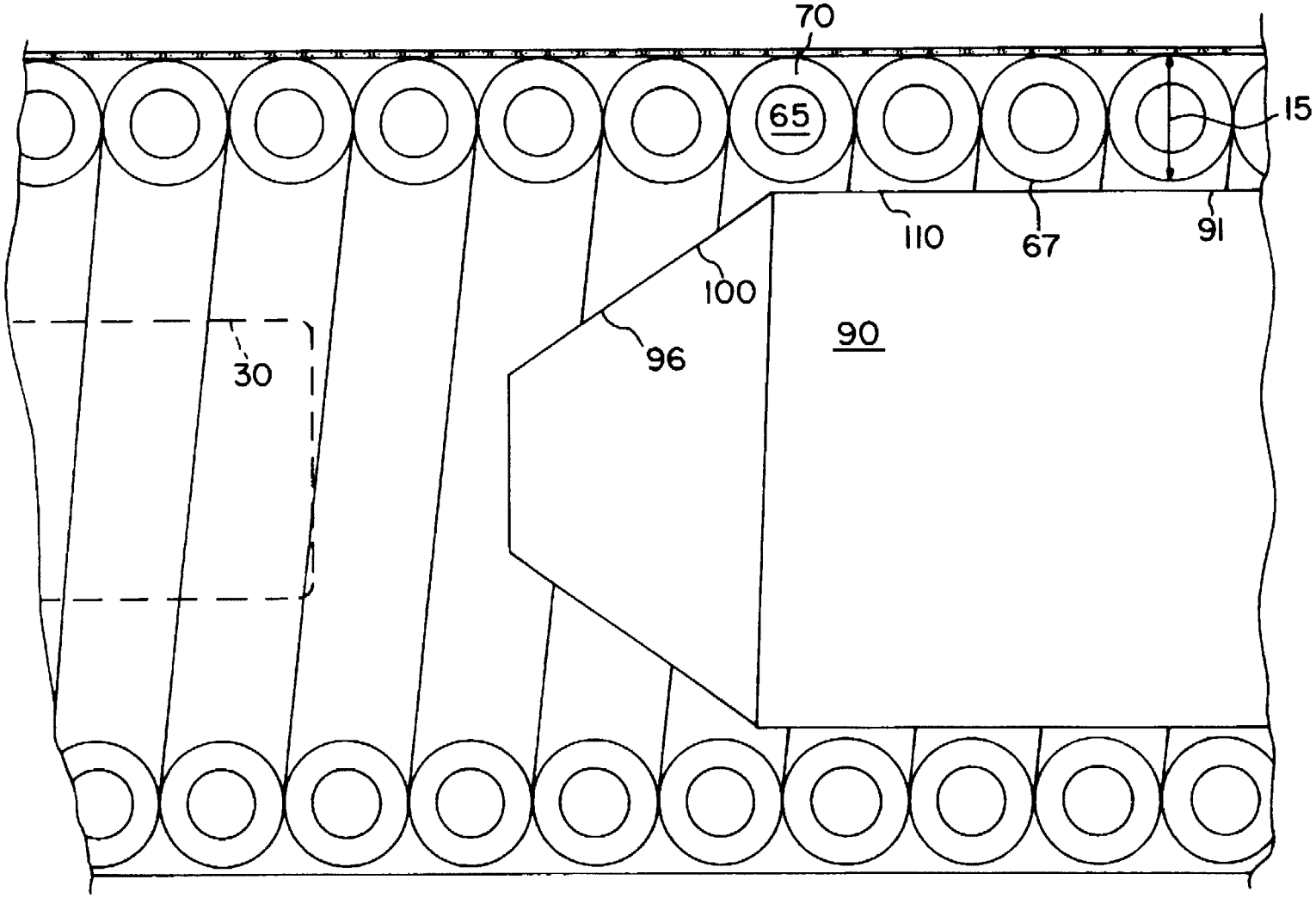
FIG. 2 is an enlarged partial cross sectional view of the top of the core of FIG. 1; and, FIG. 3 is an enlarged partial view of the heat exchanger tube detailing the heat exchanging fins in the area of the dotted circle in FIG. 2 and the products of combustion air flow therethrough.
Figure 3:
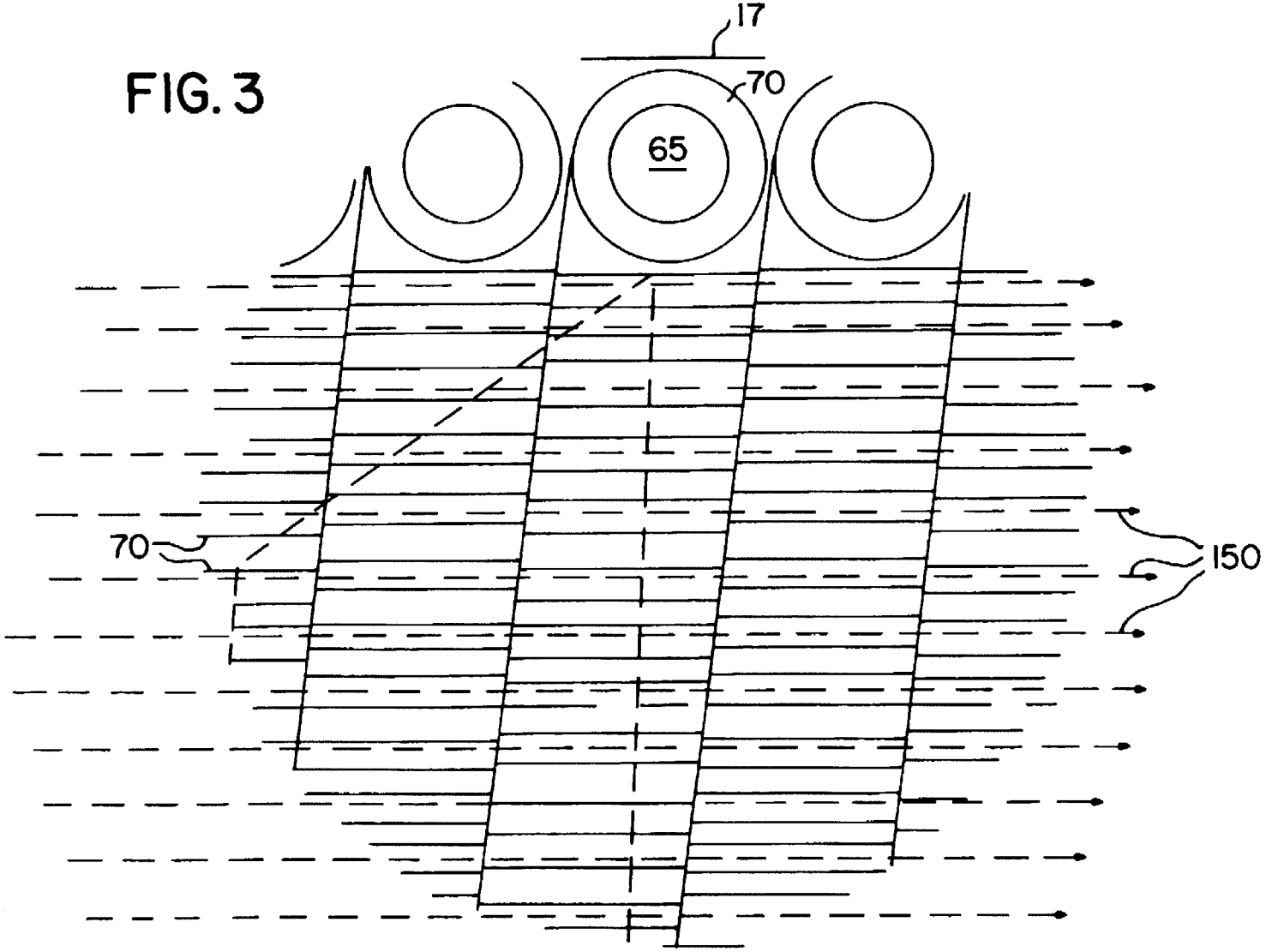

FIG. 1 is a cross sectional view of a natural gas fired water boiler incorporating the invention of this application. This boiler includes a shell 10, a burner 30, a heat exchanger tube 60, and a restrictor core 90.

The shell 10 is designed to retain the operative parts of the boiler into their operative positions in addition to providing a container for the products of combustion from the later described burner 30. The particular shell 10 disclosed is a cylinder 11 having two ends 12 and 13. This cylinder 11 is hermetically sealed so as to create an enclosed container for the products of combustion from the later described burner 30.

The particular shell 10 disclosed is constructed of stainless steel with a diameter of approximately 7" and a length of approximately 28". The first circular end 12 is adapted to removably mount the later described burner 30. The second end 13 is adapted to create a flue 15, thus allowing an exit for the products of combustion from the burner 30. With this construction, the products of combustion from the burner 30 pass from the first end 12 to the second end 13 along the longitudinal length of the shell 10, this creating an enclosed area of high temperature products of combustion for thermal transfer to the later described heat exchanger 60.

The burner 30 is the source of thermal energy for the boiler. The particular burner 30 disclosed is a cylinder having numerous small symmetrically located holes in its outer circumference. The interior 31 of this burner is pressurized by a centripetal blower of a natural gas/air mixture with burning of this mixture occurring on the outer surface thereof slightly spaced therefrom. This creates a heat source generating products of combustion which longitudinally pass through the enclosed shell 10 surrounding the heat exchanger 60, thus passing thermal energy to the water within the heat exchanger 60. A more complete description of the burner is set forth in Ihlenfield U.S. Pat. No. 4,657,506.

The burner 30 and heat exchanger 60 are contained within the shell 10. The purpose of this heat exchanger 60 is to transfer the thermal energy from the products of combustion of the burner tube 30 to the water contained within the coiled heat exchanger tube 65. The direction of water movement within the heat exchanger tube 65 can vary. It is preferred that the water within the tube 65 move within the boiler 10 from an area of relative low temperature to an area of relatively high temperature. The reason for this is that water can absorb only so many BTU in a given area for a given volumetric flow. Due to this it is preferred that directions of temperature are reversed, with the highest temperature products of combustion being located at the opposite end of the boiler from the lowest temperature water.

The particular heat exchanger 60 disclosed is a helically wrapped tube extending circumferentially around the interior of the outer diameter 17 of the shell 10. This heat exchanger tube 65 disclosed has a series of heat exchanging fins 70 spirally wrapped about such tube at an extremely small pitch for the entire length of the shell 10 between the inlet 61 and the outlet 62. The reason for this small pitch is that ideally the products of combustion pass directly longitudinally 150 along the fins 70 with no radial movement. The reason for this is that any radial movement increases the back pressures on the burner blower as well as the section within the shell 10 surrounding such burner. This back pressure lowers the overall efficiency of the boiler 10. By selecting a small pitch for the fins 70, one creates a boiler having the functionality of successive fins while retaining the manufacturing efficiency of spiral fins. This optimizes both without the manufacturing or operational inefficiencies of radial component movements of products of combustion. The possible pitch is greater than six pitch per inch. The preferred pitch is 9–9+½ fins per inch surrounding the burner 30 and 11 fins per inch surrounding the core 90. The reason for the different pitch is that with it, the heat exchanging fins 70 increase the efficiency of thermal transfer between products of combustion of the burner 30 to the water contained within the coiled heat exchanger tube 65 by increasing the relative surface area for the heat exchanger tube as the temperature of the products of combustion are reducing. Note that the inlet 61 and the outlet 62 of this heat exchanger tube 65 are not finned, thus facilitating the interconnection between the associated plumbing and the boiler.

It is preferred that the heat exchanging fins 70 have a differing spacing surrounding the burner tube 30 than they do surrounding the later described core 90. The reason for this is that again the thermal energy of the products of combustion of the boiler are greater surrounding the burner 30 than they are surrounding the later described core 90 (i.e., the air is hotter surrounding the burner). For this reason, the thermal transfer of energy is more effective nearer to the burner end 12 of the enclosed shell 10 than at the outlet end 13. By reducing the spacing of the fins 70 in the area having lower temperature, the increase in surface area produces a relatively uniform heat transfer characteristic throughout the entire length of the tube 65. This increases transfer efficiency in addition to reducing longevity difficulties due to temperatures maldistribution.

The particular heat exchanger tube 65 disclosed has an overall length of 31 feet and an overall diameter of 1.125". The fins 70 are brazed to the outer diameter of the central tube 65 with a NICROBRAZ 50 (C4–14%, P-10%, C-0.06% max., Ni-balance).

The core 90 is designed to direct the products of combustion from the burner tube 30 to surround the coiled heat exchanger tube 65 neighboring the water inlet 61 thereto. This increases the efficiency of the thermal transfer between such products of combustion and the water contained within the heat exchanger tube 65 at this location. In addition, the existence of the core 90 creates a slight back pressure surrounding the burner 30. This encourages a flow laterally through the heat exchanger surrounding the burner 30, thus increasing the thermal transfer capability of this end of the heat exchanger. In this thermal transfer, it is again important to note that the products of combustion pass longitudinally of the shell 10 surrounding the coiled heat exchanger tube 65; specifically, there is no radial component to this passage of products of combustion. This reduces the overall back pressure on the burner 30 as well as optimizing the passage of products of combustion between the shell 10 and the later described core 90.

The core 90 is designed to direct the products of combustion from the burner 30 to a narrow area in direct proximity with the coil heat exchanger tube 65 at a certain time. In the preferred embodiment disclosed, this is accomplished by making the outer diameter 91 of the core 90 approximately equal to or slightly greater than the inner diameter 67 of the coiled heat exchanger tube 65 immediately surrounding the core. This forces the products of combustion into the narrow radial distance 15 surrounding the outer diameter 91 of the core 90, thus insuring the passage of such products of combustion along the fins of the coiled heat exchanger tube 65.

In contrast with the prior art, the top 95 of the core 90 is formed in a constantly reducing diameter cross section 96. The particular constantly reducing cross section disclosed is a truncated cone. The top of the core 90 could alternately be a dome. With this design, the products of combustion from the burner tube 30 concentrate neighboring the sidewalls 100 of the top 95 of the core 90, thus concentrating heat at this particular location (in contrast for example to the sides 110 of the core 90). This causes the top 95 of the core 90 to develop high thermal energy in respect to the remainder of the core 90, thus insuring that the intersection between the top 95 of the core 90 and the surrounding coiled heat exchanger tube 65 will be at a relatively high temperature at this location. This high temperature vaporizes and or thermally destroys any unburned residue of the products of combustion which might otherwise form at this location, primarily on cold start up, thus insuring that this critical location remains free of any obstruction developed during the operation of the device.

Due to the relatively low incoming water temperature, especially on start up or where the boiler is undersized for at least part of the heating time, conventional boilers have a tendency to plug up due to the products of combustion coalescing on the relatively cold heat exchanger tube. Due to its prominence, the tube at the junction with the core was particularly susceptible. The present invention produces relatively high temperatures at this critical location, thus avoiding this plug up problem present in the prior art.

The particular core 90 has a diameter of 4.60" and an overall length of 8.50". The top 95 of the core 90 reduces in diameter to 1.50" in approximately 1.0" at the top end 95 of the core 90. The top of the core 90 is spaced within 2.0" of the bottom of the burner 30. This spacing is preferred. The top of the core 90 could alternately be spaced differently such as being in contact with the bottom of the burner.

Although it is possible for the core 90 to extend all of the way from the top 95 of the core to the end 13 of the enclosed shell 10, is preferred that the end 98 of the core 90 be displaced therefrom by a spacer 120. This spacer 120, having a lesser outer diameter than that of the inner diameter of the coiled heat exchanger tube 65, allows products of combustion to exist and circulate about the inlet end of the coiled heat exchanger tube 65 beneath the end 98 of the core 90. This increases the efficiency of the heat transfer in this particular area by allowing a pool of hot products of combustion to exist at this location. This heat transfer is further slightly facilitated by the fact that the relatively restricted flow passage flue 15 creates a slight back pressure in this critical location due to the fact that the overall aggregate cross sectional area of products of combustion passage about the fins 70 is greater than the cross sectional area of the outlet flue 15 thus insuring a certain type of dwell time of the products of combustion in the space between the spacer 120 and the shell 10 at this location. The final cooling of the combustion gases occurs in this area. Indeed with this non-restricted circulation and the incoming water, the temperature of the surrounding shell 10 is significantly lowered than would be otherwise present.

With the improved design of the boiler 10, the temperature of the flue 15 is approximately 180° for 185° constant output water, temperature at top core 1650° F., at top burner plate 325°, and about burner tube at burner surface 325° F.

Although the invention has been described in its preferred embodiment with a certain degree of particularity, it is to be understood that numerous changes can be made without deviating from the invention as hereinafter claimed.

What is claimed:

1. In a water boiler having a burner and coiled heat exchanger tube contained within an enclosed shell, the burner generating products of combustion including unburned residue, the center of the coiled tube being plugged by a core extending therein, the core having a top directed towards the burner, the improvement of the top of the core having a reducing diameter facing the burner, means for said reducing diameter top to concentrate the products of combustion flowing longitudinally away from the burner between the core and the coiled heat exchanger tube at the intersection between the top of the core and the surrounding coiled heat exchanger tube so as to develop a relatively high temperature thereat so as to destroy any unburned residue at this location.

2. The improvement of claim 1 characterized in that said reducing diameter top is a cone.

3. The improvement of claim 2 characterized in that said cone is truncated.

4. The improvement of claim 1 wherein the coiled tube is located between the core and the enclosed shell by an aggregate distance, and characterized by the addition of heat exchanging elements, said heat exchanging elements extending off of the coiled tube and said heat exchanger elements filling the aggregate distance between the core and the enclosed shell.

5. The improvement of claim 1 wherein the shell has an outlet end and the core has a bottom and characterized in that the bottom of the core is spaced from the outlet end of the core.

6. The improvement of claim 1 wherein said coiled heat exchanger tube includes fins, said fins having a pitch which directs the flow of the products of combustion in longitudinal movement with no radial flow.

7. The improvement of claim 1 characterized in that said reducing diameter top is a dome.

8. In a water boiler having a burner and coiled heat exchanger tube contained within an enclosed shell, the burner generating products of combustion including unburned residue, the center of the coiled tube being plugged by a core extending therein, the core having a top directed towards the burner, the improvement of the top of the core having a reducing diameter facing the burner, means for said reducing diameter top to concentrate the products of combustion at the intersection between the top of the core and the surrounding coiled heat exchanger tube so as to develop a relatively high temperature thereat so as to destroy any unburned residue at this location, the heat exchanger tube having externally extending fins, and said fins and the core defining longitudinally extending discrete air flow passages past the core.

9. In a water boiler having a burner and coiled heat exchanger tube contained within an enclosed shell, the burner generating products of combustion including unburned residue, the center of the coiled tube being plugged by a core extending therein, the core having a top directed towards the burner, the burner having an inward end, the improvement of the top of the core having a reducing diameter facing the burner means for said reducing diameter top to concentrate the products of combustion at the intersection between the top of the core and the surrounding coiled heat exchanger tube so as to develop a relatively high temperature thereat so as to destroy any unburned residue at this location, and the top of said reducing diameter core contacting the inward end of the burner.

10. In a water boiler having a burner and a coiled heat exchanger within an enclosed shell having an outlet end, the center of the coiled tube being plugged by a core having a bottom, the improvement of the bottom of the core being spaced from the outlet end of the shell to allow products of combustion to freely circulate in the resultant spaces, a spacer, and said spacer being located between the bottom of the core and the outlet end of the shell.

11. The improvement of claim 10 wherein the coiled tube is located between the core and the enclosed shell by an aggregate distance, and characterized by the addition of heat exchanging elements, said heat exchanging elements extending off of the coiled tube and said heat exchanger elements filling the aggregate distance between the core and the enclosed shell.

12. The improvement of claim 10 characterized in that the heat exchanger tube has externally extending fins, said fins and the core defining longitudinally extending discrete air flow passages past the core.

13. The improvement of claim 10 wherein the core has a top directed towards the burner and characterized n that the top of the core has a reducing diameter facing the burner.

14. The improvement of claim 13 characterized in that said reducing diameter top is a cone.

15. The improvement of claim 13 wherein the coiled tube is located between the core and the enclosed shell by an aggregate distance, and characterized by the addition of heat exchanging elements, said heat exchanging elements extending off of the coiled tube and said heat exchanger elements filling the aggregate distance between the core and the enclosed shell.

16. In a water boiler having a burner and coiled heat exchanger tube contained within an enclosed shell, the burner producing products of combustion including unburned residue, the center of the coiled tube being plugged by a core extending therein with a top facing the burner, the burner being at one longitudinal inlet end of the shell and the core being at the other longitudinal outlet end of the shell, the coiled tube being spaced from the core and enclosed shell by a radial aggregate distance, the improvement of the top of the core having a constantly reducing diameter facing the burner, means for said reducing diameter top to concentrate the products of combustion flowing longitudinally away from the burner the core and the coiled heat exchanger tube at the intersection between the top of the core and the surrounding coiled heat exchanger tube so as to develop a relatively high temperature thereat so as to destroy any unburned residue at this location, the coiled heat exchanger tube having heat exchanging elements, said heat exchanging elements extending off of the coiled tube, said heat exchanging elements filling the radial aggregate distance between core and the enclosed shell, and said heat exchanging elements producing longitudinal but not radial movement of the products of combustion between the core and enclosed shell as such products move between the inlet and outlet ends.

17. The improvement of claim 16 characterized in that said heat exchanging elements are fins, and said fins extending symmetrically off of the coiled tube.

18. In a water boiler having a burner and coiled heat exchanger tube contained within an enclosed shell, the burner producing products of combustion, the center of the coiled tube being plugged by a core extending therein with a top facing the burner, the burner being at one longitudinal inlet end of the shell and the core being at the other longitudinal outlet end of the shell, the coiled tube being spaced from the core and enclosed shell by a radial aggregate distance, the improvement of the top of the core having a constantly reducing diameter facing the burner, means for said reducing diameter top to concentrate the products of combustion at the intersection between the top of the core and the surrounding coiled heat exchanger tube so as to develop a relatively high temperature thereat so as to develop any unburned residue at this location the coiled heat exchanger tube having heat exchanging elements, said heat exchanging elements extending off of the coiled tube, said heat exchanging elements filling the radial aggregate distance between care and the enclosed shell, said heat exchanging elements producing longitudinal but not radial movement of the products of combustion between the core and the enclosed shell as such products move between the inlet and outlet ends between the inlet and outlet ends, said heat exchanging elements being fins, said fins are spirally extending at a certain pitch about the coiled tube, and said certain pitch increasing along with the surface area of said fins as the temperature of the products of combustion surrounding the fins decreases.

19. The improvement of claim 18 wherein said certain pitch of said fins is substantially nine fins per inch surrounding the burner and substantially eleven fins per inch surrounding the core.

20. In a water boiler having a burner and coiled heat exchanger tube contained within an enclosed shell, the burner producing products of combustion including unburned residue, the center of the coiled tube being plugged by a core extending therein with a top facing the burner, the burner being at one longitudinal inlet end of the shell and the core being at the other longitudinal outlet end of the shell, the coiled tube being spaced from the core and enclosed shell by a radial aggregate distance, the improvement of said heat exchanging elements extending off of the coiled tube, said heat exchanging elements filling the radial aggregate distance between core and the enclosed shell, said heat exchanging elements producing longitudinal but not radial movement of the products of combustion between the core and enclosed shell as such products move between the inlet and outlet ends said heat exchanging elements being fins said fins extending symmetrically off of the coiled tube and said fins having a pitch and said pitch of said fins being less surrounding the burner than surrounding the core.

21. In a water boiler having a burner and coiled heat exchanger tube contained within an enclosed shell, the burner producing products of combustion including unburned residue, the center of the coiled tube being plugged by a core extending therein with a top facing the burner, the burner being at one longitudinal inlet end of the shell and the core being at the other longitudinal outlet end of the shell, the coiled tube being spaced from the core and enclosed shell by a radial aggregate distance directed towards the burner, the burner having an inward end, the improvement of the top of the core having a constantly reducing diameter facing the burner, means for said reducing diameter top to concentrate the products of combustion at the intersection between the top of the core and the surrounding coiled heat exchanger tube so as to develop a relatively high temperature thereat so as to destroy unburned residue at this location, the top of the core contacting the inward end of the burner, said heat exchanging elements extending off of the coiled tube, said heat exchanging elements filling the radial aggregate distance between core and the enclosed shell, and said heat exchanging elements producing longitudinal but not radical movement of the products of combustion between the core and enclosed shell as such products move between the inlet and outlet ends.

22. In a water boiler having a burner and coiled heat exchanger tube contained within an enclosed shell having an outlet end, the burner producing products of combustion, the center of the coiled tube being plugged by a core extending therein with a top facing the burner, the core having a bottom, the burner being at one longitudinal inlet end of the shell and the core being near the other longitudinal outlet end of the shell, the coiled tube being spaced from the core and enclosed shell by a radial aggregate distance, the improvement of the bottom of the core being spaced from the outlet end of the shell, a spacer, said spacer being located between the bottom of the core and the outlet end of the shell, the coiled heat exchanger tube having heat exchanging elements, said heat exchanging elements extending off of the coiled tube, said heat exchanging elements filling the radial aggregate distance between core and the enclosed shell, and said heat exchanging elements producing longitudinal but not radial movement of the products of combustion between the core and enclosed shell as such products move between the inlet and outlet ends.

23. The improvement of claim 22 characterized in that said heat exchanging elements are fins, and said fins extending symmetrically off of the coiled tube.

24. The improvement of claim 22 characterized in that the top of the core has a constantly reducing diameter facing the burner.

25. In a water boiler having a burner with an inner end and coiled heat exchanger tube contained within an enclosed shell, the shell having a length, the burner producing products of combustion including unburned residue, the center of the coiled tube being plugged by a core having an outer diameter and extending in the enclosed shell with a top facing the burner, the burner being at one longitudinal end of the shell and the core being at the other longitudinal end of the shell, the coiled tube being spaced from the core, and enclosed shell by an aggregate radial distance, the improvement of the top of the core having a constantly reducing diameter facing the burner, means for said reducing diameter top to concentrate the products of combustion at the intersection between the top of the core and the surrounding coiled heat exchanger tube so as to develop a relatively high temperature thereat so as to destroy any unburned residue at this location, the coiled heat exchanger tube having heat exchanging fins, said heat exchanging fins being circular in cross section with said tube substantially centered therein, said heat exchanging fins extending off of the coiled tube at a pitch which creates successive fins for substantially the entire length of the shell, said heat exchanging fins filling the aggregate radial distance between core and the enclosed shell, said successive heat exchanging fins cutting slightly into the outer diameter of the core, and said heat exchanging fins producing longitudinal but not radial movement of the products of combustion between the core and enclosed shell as such products move between the inlet and outlet ends.

26. In a water boiler having a burner with an inner end and coiled heat exchanger tube contained within an enclosed shell, the burner producing products of combustion including unburned residue, the center of the coiled tube being plugged by a core having an outer diameter and extending in the enclosed shell with a top facing the burner, the burner being at one longitudinal end of the shell and the core being at the other longitudinal end of the shell, the coiled tube being spaced from the core, and enclosed shell by an aggregate radial distance, the improvement of the top of the core having a constantly reducing diameter facing the burner, means for said reducing diameter top to concentrate the products of combustion at the intersection between the top of the core and the surrounding coiled heat exchanger tube so as to develop a relatively high temperature thereat so as to destroy any unburned residue at this location, the coiled heat exchanger tube having heat exchanging fins, said heat exchanging fins being circular in cross section with said tube substantially centered therein, said heat exchanging fins extending off of the coiled tube, said heat exchanging fins filling the aggregate radial distance between core and the enclosed shell, said heat exchanging fins cutting slightly into the outer diameter of the core, and said heat exchanging fins producing longitudinal but not radial movement of the products of combustion between the core and enclosed shell as such products move between the inlet and outlet ends, said fins being spirally extending at a certain pitch about the coiled tube, and said certain pitch increasing along with the surface area of said fins as the temperature of the products of combustion surrounding the fins decreases.

27. The improvement of claim 26 wherein said certain pitch of said fins is substantially nine fins per inch surrounding the burner and substantially eleven fins per inch surrounding the core.

28. In a water boiler having a burner with an inner end and coiled heat exchanger tube contained within an enclosed shell, the burner producing products of combustion, the center of the coiled tube being plugged by a core having an outer diameter and extending in the enclosed shell with a top facing the burner, the burner being at one longitudinal end of the shell and the core being at the other longitudinal end of the shell, the coiled tube being spaced from the core, and enclosed shell by an aggregate radial distance, the improvement of the coiled heat exchanger tube having heat exchanging fins, said heat exchanging fins being circular in cross section with said tube substantially centered therein, said heat exchanging fins extending off of the coiled tube, said heat exchanging fins filling the aggregate radial distance between core and the enclosed shell, said heat exchanging fins cutting slightly into the outer diameter of the core, said heat exchanging fins producing longitudinal but not radial movement of the products of combustion between the core and enclosed shell as such products move between the inlet and outlet ends, said fins having a pitch and said pitch of said fins being less surrounding the burner than surrounding the core.

29. In a water boiler having a burner with an inner end and coiled heat exchanger tube contained within an enclosed shell, the burner producing products of combustion including unburned residue, the burner having an inward end, the improvement of the top of the core having a constantly reducing diameter facing the burner, means for said reducing diameter top to concentrate the products of combustion at the intersection between the top of the core and the surrounding coiled heat exchanger tube so as to develop a relatively high temperature thereat so as to destroy any unburned residue at this location, the coiled heat exchanger tube having heat exchanging fins, said heat exchanging fins being circular in cross section with said tube substantially centered therein, said heat exchanging fins extending off of the coiled tube, said heat exchanging fins filling the aggregate radial distance between core and the enclosed shell, said heat exchanging fins cutting slightly into the after diameter of the core, and said heat exchanging fins producing longitudinal but not radial movement of the products of combustion between the core and enclosed shell as such producing move between the inlet and outlet ends, and the top of the core contacting the inward end of the burner.

30. In a water boiler having a burner with an inner end and coiled heat exchanger tube contained within an enclosed shell the burner producing products of combustion, the center of the coiled tube being plugged by a core having an outer diameter and extending in the enclosed shell with a top facing the burner, the burner being at one longitudinal end of the shell and the core being at the other longitudinal end of the shell, the coiled tube being spaced from the core, and enclosed shell by an aggregate radial distance, the improvement of the coiled heat exchanger tube having heat exchange fins, said heat exchange fins being circular in cross section with said tube substantially centered therein, said heat exchanging fins extending off of the coiled tube, said heat exchanging fins filling the aggregate radial distance between core and the enclosed shell said heat exchanging fins cutting slightly into the outer diameter of the core, said heat exchanging fins producing longitudinal but not radial movement of the products of combustion between the core and enclosed shell as such products move between the inlet and outlet ends said fins having a pitch said pitch of said fins being less surrounding the burner than surrounding the core, and said pitch of said fins changing substantially at the top of the core.

31. In a water boiler having a burner with an inner end and coiled heat exchanger tube contained within an enclosed shell having an outlet and a length, the burner producing products of combustion including unburned residue, the center of the coiled tube being plugged by a core having an outer diameter and extending in the enclosed shell with a top facing the burner and a bottom facing the outlet of the shell, the burner being at one longitudinal end of the shell and the core being at the other longitudinal end of the shell, the coiled tube being spaced from the core and enclosed shell by an aggregate radial distance, the improvement of the top of the core having a constantly reducing diameter facing the burner, means for said reducing diameter top to concentrate the products of combustion at the intersection between the top of the core and the surrounding coiled heat exchanger tube so as to develop a relatively high temperature thereat so as to destroy any unburned residue at this location, the coiled heat exchanger tube having heat exchanging fins, said heat exchanging fins being circular in cross section with said tube substantially centered therein, said heat exchanging fins extending off of the coiled tube at a pitch which creates successive fins for substantially the entire length of the shell, said heat exchanging fins filling the aggregate radial distance between core and the enclosed shell, said successive heat exchanging fins cutting slightly into the outer diameter of the core, and said heat exchanging fins producing longitudinal but not radial movement of the products of combustion between the core and enclosed shell as such products move between the inlet and outlet ends.

32. In a water boiler having a burner with an inner end and coiled heat exchanger tube contained within an enclosed shell having an outlet, the burner producing products of combustion including unburned residue, the center of the coiled tube being plugged by a core having an outer diameter and extending in the enclosed shell with a top facing the burner and a bottom facing the outlet of the shell, the burner being at one longitudinal end of the shell and the core being at the other longitudinal end of the shell, the coiled tube being spaced from the core and enclosed shell by an aggregate radial distance, the improvement of the top of the core having a constantly reducing diameter facing the burner, means for said reducing diameter top to concentrate the products of combustion at the intersection between the top of the core and the surrounding coiled heat exchanger tube so as to develop a relatively high temperature thereat so as to destroy any unburned residue at this location, the coiled heat exchanger tube having heat exchanging fins, said heat exchanging fins being circular in cross section with said tube substantially centered therein, said heat exchanging fins extending off of the coiled tube, said heat exchanging fins filling the aggregate radial distance between core and the enclosed shell, said heat exchanging fins cutting slightly into the outer diameter of the core, and said heat exchanging fins producing longitudinal but not radial movement of the products of combustion between the core and enclosed shell as such products move between the inlet and outlet ends, said fins being spirally extending at a certain pitch about the coiled tube, and said certain pitch increasing along with the surface area of said fins as the temperature of the products of combustion surrounding said fins decreases.

33. The improvement of claim 32 wherein said certain pitch of said fins is substantially nine fins per inch surrounding the burner and substantially eleven fins per inch surrounding the core.

34. In a water boiler having a burner with an inner end and coiled heat exchanger tube contained within an enclosed shell having an outlet, the burner producing products of combustion, the center of the coiled tube being plugged by a core having an outer diameter and extending in the enclosed shell with a top facing the burner and a bottom facing the outlet of the shell, the burner being at one longitudinal end of the shell and the core being at the other longitudinal end of the shell, the coiled tube being spaced from the core and enclosed shell by an aggregate radial distance, the improvement of the top of the core having a constantly reducing diameter facing the burner, a spacer, said spacer being between the outlet of the shell and the bottom of the core, the coiled heat exchanger tube having heat exchanging fins, said heat exchanging fins being circular in cross section with said tube substantially centered therein, said heat exchanging fins extending off of the coiled tube, said heat exchanging fins filling the aggregate radial distance between core and the enclosed shell, said heat exchanging fins cutting slightly into the outer diameter of the core, said heat exchanging fins producing longitudinal but not radial movement of the products of combustion between the core and enclosed shell as such products move between the inlet and outlet ends, and said fins having a pitch and said pitch of said fins being less surrounding the burner than surrounding the core.

35. The improvement of claim 34 characterized in that said pitch of said fins changes substantially at the top of the core.

36. In a water boiler having a burner with an inner end and coiled heat exchanger tube contained within an enclosed shell having an outlet, the burner producing products of combustion including unburned residue, the burner has an inward end, the center of the coiled tube being plugged by a core having an outer diameter and extending in the enclosed shell with a top facing the burner and a bottom facing the outlet of the shell, the burner being at one longitudinal end of the shell and the core being at the other longitudinal end of the shell, the coiled tube being spaced from the core and enclosed shell by an aggregate radial distance, the improvement of the top of the core having a constantly reducing diameter facing the burner, means for said reducing diameter top to concentrate the products of combustion at the intersection between the top of the core and the surrounding coiled heat exchanger tube so as to develop a relatively high temperature thereat so as to destroy any unburned residue at this location, the coiled heat exchanger tube having heat exchanging fins, said heat exchanging fins being circular in cross section with said tube substantially centered therein, said heat exchanging fins extending off of the coiled tube, said heat exchanging fins filling the aggregate radial distance between core and the enclosed shell, said heat exchanging fins cutting slightly into the outer diameter of the core, said heat exchanging fins producing longitudinal but not radial movement of the products of combustion between the core and enclosed shell as such products move between the inlet and outlet ends, and the top of the core contacting the inward end of the burner.

* * * * *